US011851955B2

(12) United States Patent
Harvey et al.

(10) Patent No.: US 11,851,955 B2
(45) Date of Patent: Dec. 26, 2023

(54) DOWNHOLE TOOL WITH RADIAL SHOCK ABSORBER AND STABILIZER

(71) Applicant: General Downhole Tools, Ltd., Calgary (CA)

(72) Inventors: Michael Harvey, Calgary (CA); David Devlin, Calgary (CA)

(73) Assignee: General Downhole Tools Ltd., Calgary (CA)

( * ) Notice: Subject to any disclaimer, the term of this patent is extended or adjusted under 35 U.S.C. 154(b) by 0 days.

(21) Appl. No.: 17/686,918

(22) Filed: Mar. 4, 2022

(65) Prior Publication Data

US 2022/0213740 A1 Jul. 7, 2022

Related U.S. Application Data

(60) Provisional application No. 63/134,570, filed on Jan. 6, 2021.

(51) Int. Cl.
*E21B 17/10* (2006.01)
*E21B 17/042* (2006.01)
*E21B 17/04* (2006.01)

(52) U.S. Cl.
CPC ..... *E21B 17/1078* (2013.01); *E21B 17/041* (2020.05); *E21B 17/042* (2013.01)

(58) Field of Classification Search
CPC .. E21B 17/10; E21B 17/1078; E21B 17/1041; E21B 17/042
See application file for complete search history.

(56) References Cited

U.S. PATENT DOCUMENTS 3,080,924 A * 3/1963 Baker ..... E21B 23/04115 166/241.1
4,394,881 A * 7/1983 Shirley ..... E21B 7/062 166/319
5,265,684 A * 11/1993 Rosenhauch ..... E21B 17/1078 175/325.2
5,547,031 A * 8/1996 Warren ..... E21B 7/06 175/73
6,920,944 B2 * 7/2005 Eppink ..... E21B 10/322 175/269
6,997,258 B2 * 2/2006 Homan ..... G01V 11/005 166/100
7,878,272 B2 * 2/2011 Eppink ..... E21B 17/1014 175/325.1
9,157,281 B2 10/2015 Harvey et al.
9,840,875 B2 12/2017 Harvey et al.
(Continued)

FOREIGN PATENT DOCUMENTS

WO WO 2020223825 * 11/2020 ..... E21B 44/00

*Primary Examiner* — Yong-Suk (Philip) Ro
(74) *Attorney, Agent, or Firm* — Dickinson Wright PLLC

(57) ABSTRACT

A device for use downhole in a drill string includes a body that is cylindrical. The body has a longitudinal axis and top and bottom threads that can couple the body to other elements of the drill string. A radial shock absorber is coupled to an exterior of the body. The radial shock absorber has a piston with a piston axis. A portion of the piston extends to an exterior of the body. The piston can move along the piston axis between a retracted position and an extended position. In addition, a spring is located between the body and the piston. The spring can bias the piston, along the piston axis, radially outward relative to the longitudinal axis of the body.

16 Claims, 5 Drawing Sheets

(56) References Cited

U.S. PATENT DOCUMENTS

| | | | | |
|---|---|---|---|---|
| 10,066,438 | B2 * | 9/2018 | Kirkhope | E21B 7/062 |
| 10,113,367 | B2 | 10/2018 | Harvey et al. | |
| 10,794,117 | B2 | 10/2020 | Harvey et al. | |
| 2006/0096786 | A1 * | 5/2006 | Wells | E21B 7/067<br>175/267 |
| 2015/0259997 | A1 * | 9/2015 | Millet | E21B 23/01<br>166/212 |

* cited by examiner

DOWNHOLE TOOL WITH RADIAL SHOCK ABSORBER AND STABILIZER

REFERENCE TO RELATED APPLICATION

This application claims priority to and the benefit of U.S. Prov. Pat. App. No. 63/134,570, filed Jan. 6, 2021, which is incorporated herein by reference in its entirety.

TECHNICAL FIELD

This disclosure relates generally to technological improvements in the field of downhole tools used in well drilling and, in particular, to a downhole tool with a radial shock absorber and stabilizer.

BACKGROUND

Conventional means of performing work in an oil or gas well includes drilling while pumping drilling fluid through a pipe or drill string to a drill bit that is cutting a hole in an earthen formation. A drill string typically contains a variety components including tools suitable for performing various functions related to the drilling operation. Various downhole tools may include various elements for cutting and/or stabilizing a drill string within the well bore.

Existing downhole tools may commonly include one or more rigidly fixed cutting elements that have two only modes of operation: engaged or disengaged, and may be operated hydraulically. The limitations of such rigid systems may be disadvantageous in some circumstances, so improvements to downhole tools continue to be of interest.

SUMMARY

The present disclosure describes embodiments of a downhole tool. For example, a device for use downhole in a drill string can include a body that is cylindrical. The body can have a longitudinal axis and top and bottom threads configured to couple the body to other elements of the drill string. A radial shock absorber can be coupled to an exterior of the body. The radial shock absorber can include a piston having a piston axis. A portion of the piston can extend to an exterior of the body. The piston can be configured to move along the piston axis between a retracted position and an extended position. In addition, a spring can be located between the body and the piston. The spring can be configured to bias the piston, along the piston axis, radially outward relative to the longitudinal axis of the body.

Other technical features may be readily apparent to one skilled in the art from the following figures, descriptions, and claims. These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of 'a', 'an', and 'the' include plural referents unless the context clearly dictates otherwise.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

Figure 1:
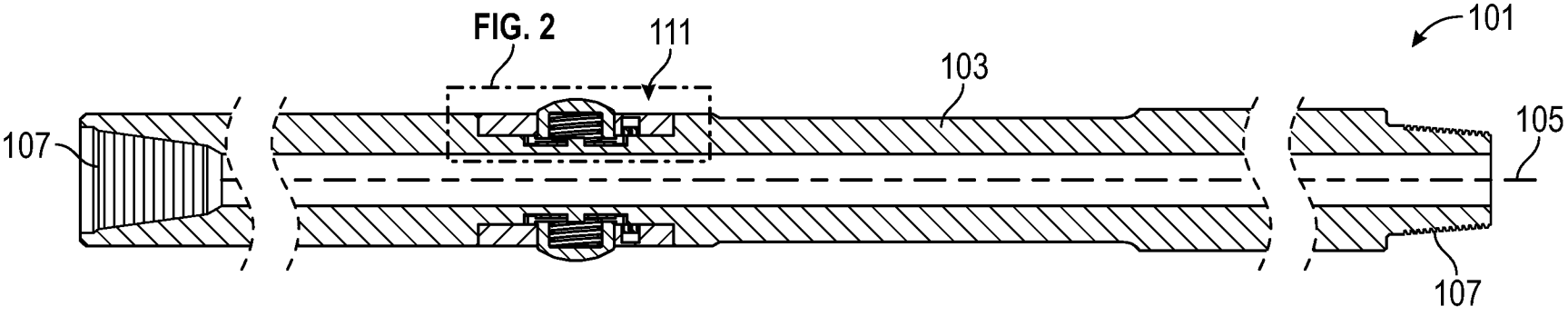
FIG. 1 is a longitudinal sectional side view of an embodiment of a downhole tool.
Figure 2:
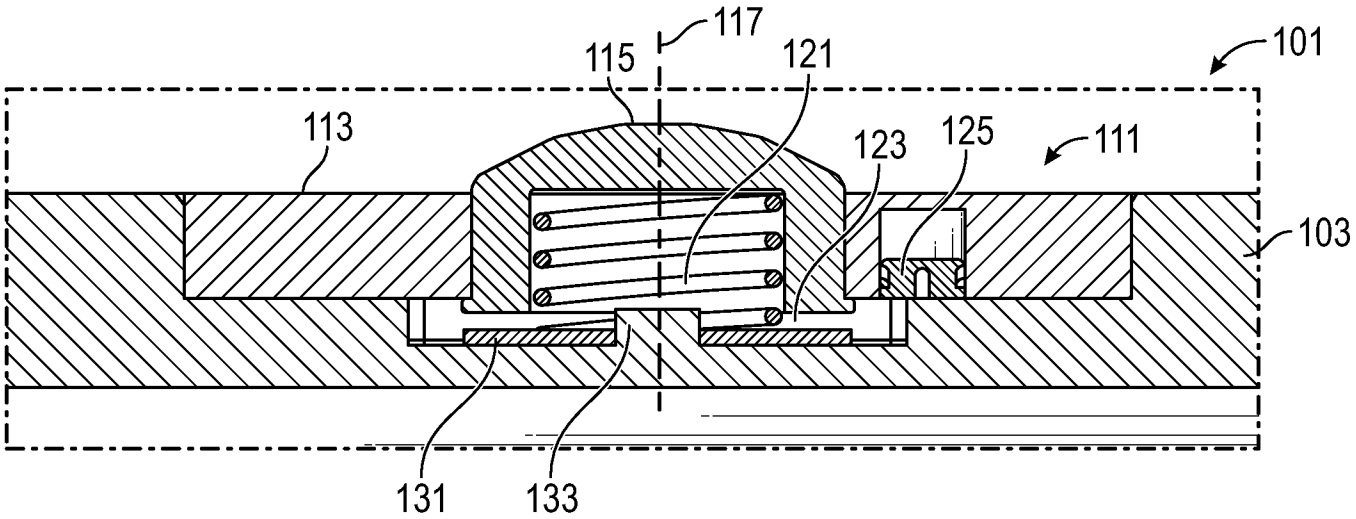
FIG. 2 is an enlarged, longitudinal sectional side view of a portion of an embodiment of the downhole tool.

FIGS. 1-6 disclose embodiments of a downhole tool and methods of using a downhole tool. Various embodiments describe the principles of this disclosure and are for illustration only. The elements and limitations of these examples should not be construed in any way to limit the scope of the disclosure.

Embodiments of a device 101 for a downhole tool in a drill string are disclosed. Versions of the device 101 can include a body 103 that is cylindrical and comprises a longitudinal axis 105. The body 103 can further include top and bottom threads 107 that are configured to couple the body 103 to other elements of the drill string.

Examples of the device 101 can include one or more (e.g., two are shown; four also is an option) radial shock absorbers 111 coupled to an exterior of the body 103. Each radial shock absorber 111 can be located in a recess in the body 103 and have a sealed cover plate 113 coupled to the body 103, such as with fasteners.

Embodiments of the radial shock absorber also can include a piston 115 having a piston axis 117. The piston 115 can be mounted between the body 103 and the cover plate 113. A portion of the piston 115 can extend through a hole in the cover plate 113. The piston 115 can be configured to move along the piston axis 117.

Versions of the device 101 can comprise a spring 121. The spring 121 can be located between the body 103 and the piston 115. Examples of the spring 121 can be configured to bias the piston 115 (along the piston axis 117) radially outward relative to the longitudinal axis 105 of the body 103.

Embodiments of the radial shock absorber 111 can further comprise a vibration dampener 123 to dampen movement of the piston 115. For example, the vibration dampener 123 can comprise a hydraulic dampener. The device can be provided with the radial shock absorber 111 so it is configured to hold the device 101 stationary in a well bore. In addition, the radial shock absorber 111 can be configured to be actuated hydraulically.

In some examples, the radial shock absorber 111 can further comprise an additional piston 125 that is hydraulically coupled via a calibrated orifice to the piston 115 to compensate for and dampen movement of the piston 115. The device 101 can further comprise an electronic control to actuate the radial shock absorber. Examples of electronic controls are described in patent application serial number CA2020050635, filed May 8, 2020, which is incorporated herein by reference in its entirety.

Figure 5:
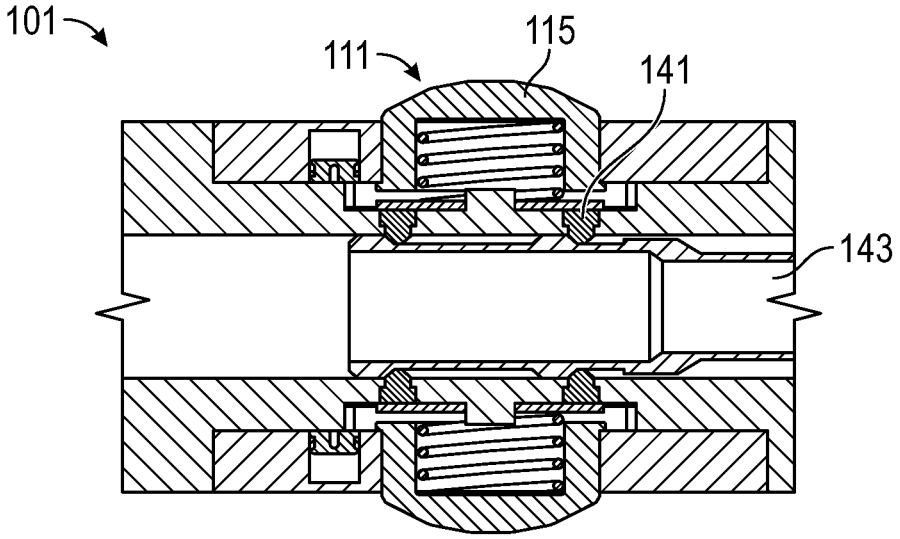
FIG. 5 is an enlarged, longitudinal sectional view of another embodiment of the downhole tool in an unlocked position.
Figure 6:
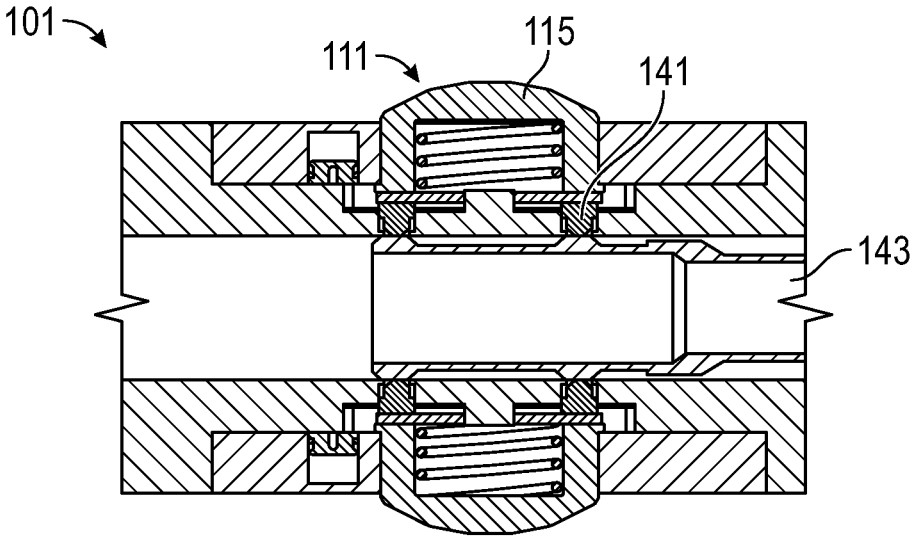
FIG. 6 is an enlarged, longitudinal sectional view of the downhole tool of FIG. 5 in a locked position.

Embodiments of the piston 115 and spring 121 can be coaxial. As shown in FIG. 5, the radial shock absorber 111 can further comprise a central axial stem 133 on which the spring 121 is mounted. In addition, the radial shock absorber 111 can further comprise a sacrificial bearing 131 (e.g., a bronze washer) coupled around the central axial stem 133 between the device 101 and the piston 115.

Figure 3:
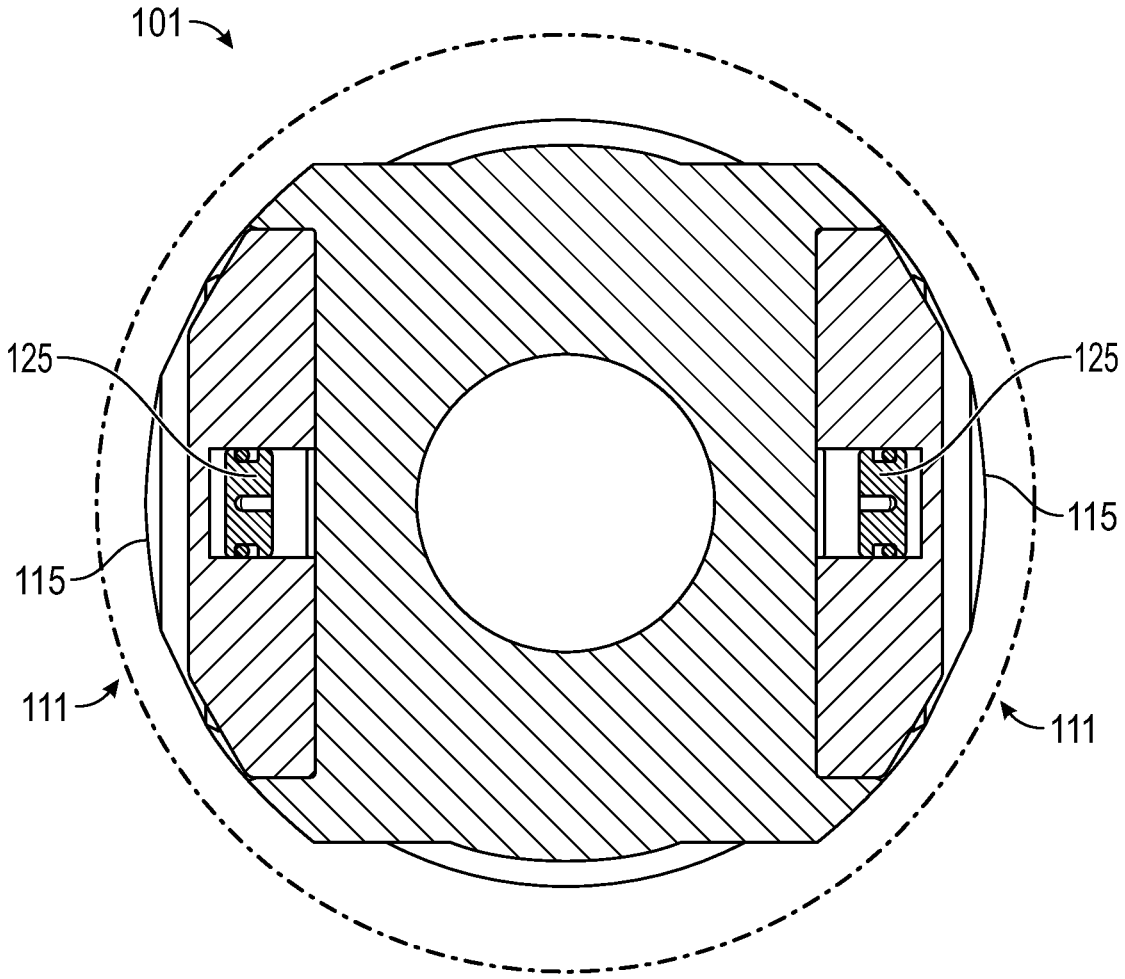
FIG. 3 is an axial end view of an embodiment of the downhole tool in a retracted position.
Figure 4:
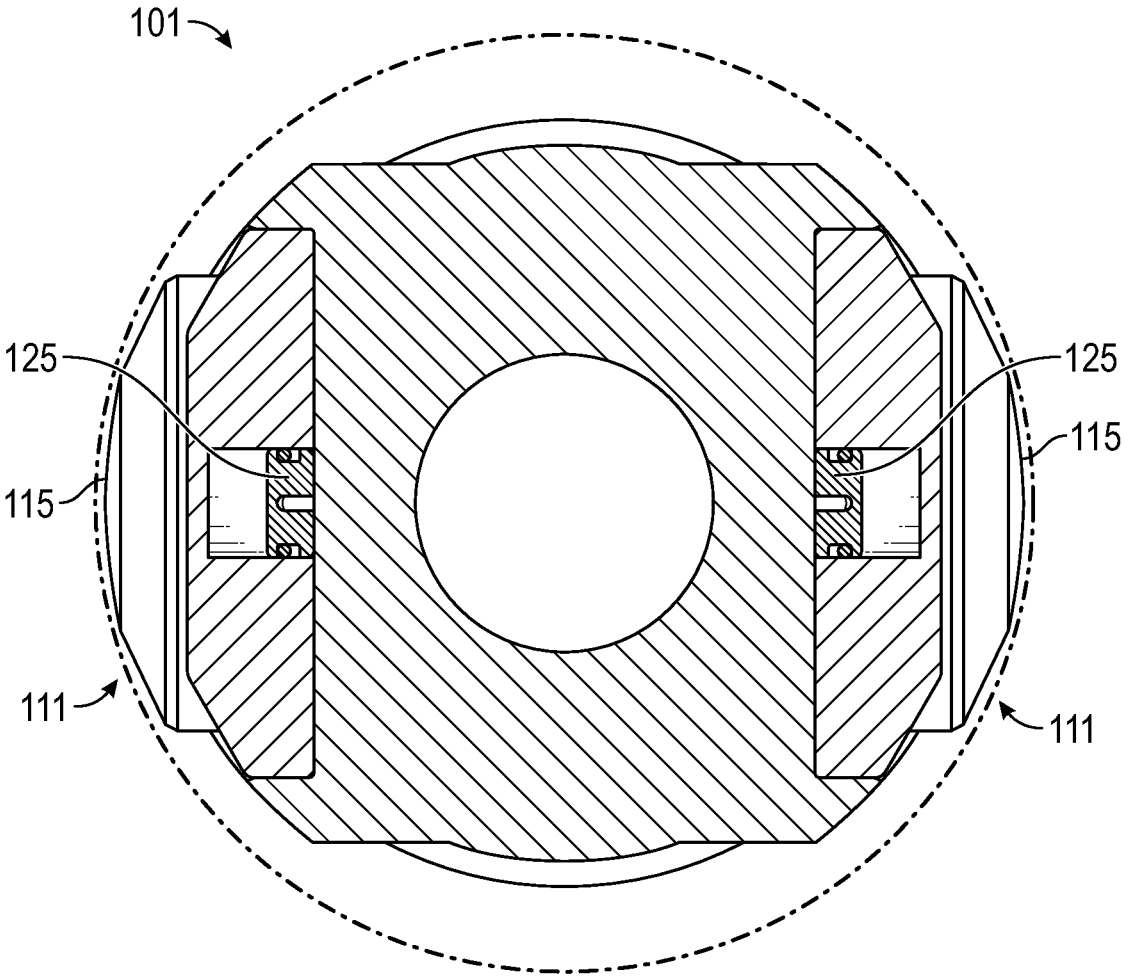
FIG. 4 is an axial end view of an embodiment of the downhole tool in an extended position.

FIG. 3 is an axial end view of an embodiment of the device with the piston 115 in a retracted position relative to (e.g., at a smaller diameter than) the well bore. FIG. 4 is an axial end view of an embodiment of the device 101 with the piston 115 in an extended position relative to the well bore. The extended position can directly contact (e.g., at a same diameter as) the well bore, in some embodiments.

According to various embodiments, the downhole tool may be suitable to wholly or partially replace and improve functions of conventional shock absorbers, reaming tools, hole openers, stabilization elements, and other downhole tools as would be apparent to one having ordinary skill in the art. Further, the spring action described herein can act to reduce the instance of unwanted jamming, grabbing, and catching of friction elements as may be experienced with some conventional tools.

According to still other embodiments (FIGS. 5-6), the one or more deployable portions (e.g., pistons 115) of the downhole tool 101 can be "locked" in the extended position (FIG. 6) and controlled to act as conventional rigid bodies without the spring action, when such a mode is desired. The downhole tool 101 can have a locking mechanism 141 coupled to the piston 115 and a locking sleeve 143 coupled to the body 103. In the retracted position (FIG. 5), the locking sleeve 143 does not engage the locking mechanism 141. In the extended position (FIG. 6), the locking sleeve 143 can be selectively actuated to engage the locking mechanism 141 to lock the piston 115 in the extended position. To release the piston 115 from the extended position, the locking sleeve 143 can be actuated to disengage the locking mechanism 141.

According to some embodiments, the radial shock absorber 111 may be deployed by a control mechanism. For example, the control mechanism can be a hydraulic control, a vibrational dampening control, a shock dampening control, an electronic control, a combination of the foresaid control types, or by another suitable control or signaling method as would be apparent to one having ordinary skill in the art.

A variable force of the spring 121, according to some embodiments, may act to provide a more nuanced amount of contact with the well wall than is currently possible with conventional downhole tools. For example, conventional downhole cleaning tools may allow only for full engagement or full disengagement with the well wall. Embodiments of the spring 121 may apply a more uniform force between piston 115 and the well bore because radial travel (relative to longitudinal axis 105) of the piston 105 allows it to move and more naturally follow the contours of a well bore.

According to some embodiments, the force of the spring 121 may be adjusted remotely during a drilling operation. For example, it can be adjusted using an appropriate control signal. In some embodiments, the spring force of spring 121 may be adjusted by physically changing the spring element.

According to some embodiments, the piston 115 may be deployed by a control mechanism. For example, the control mechanism can be a hydraulic control, a vibrational control, an electronic control, a combination of the foresaid control types, or by another suitable control or signaling method as would be apparent to one having ordinary skill in the art.

The one or more additional pistons 125 can be hydraulically coupled via the calibrated orifice to the piston 115 to compensate for and dampen movement of the piston 115 and hydraulic fluid. As the piston 115 moves radially outward, fluid is drawn from the additional piston 123 to the fluid reservoir of piston 115. When the piston 115 moves radially inward, fluid is delivered from the piston 115 to the additional piston 123, which acts as a vibration dampener to absorb at least one of lateral shock forces, cutting vibrations, and drill string harmonics.

Embodiments of the piston 115 can have a range of travel along the piston axis 117. For example, the range of travel can be up to about ⅛ inch, up to 3/16 inch, up to ¼ inch, up to ½ inch or, in some versions, up to 1 inch. The range of travel also can be expressed in a range between any of these values, such as about ⅛ inch to about 3/16 inch, for example.

Figure 7:
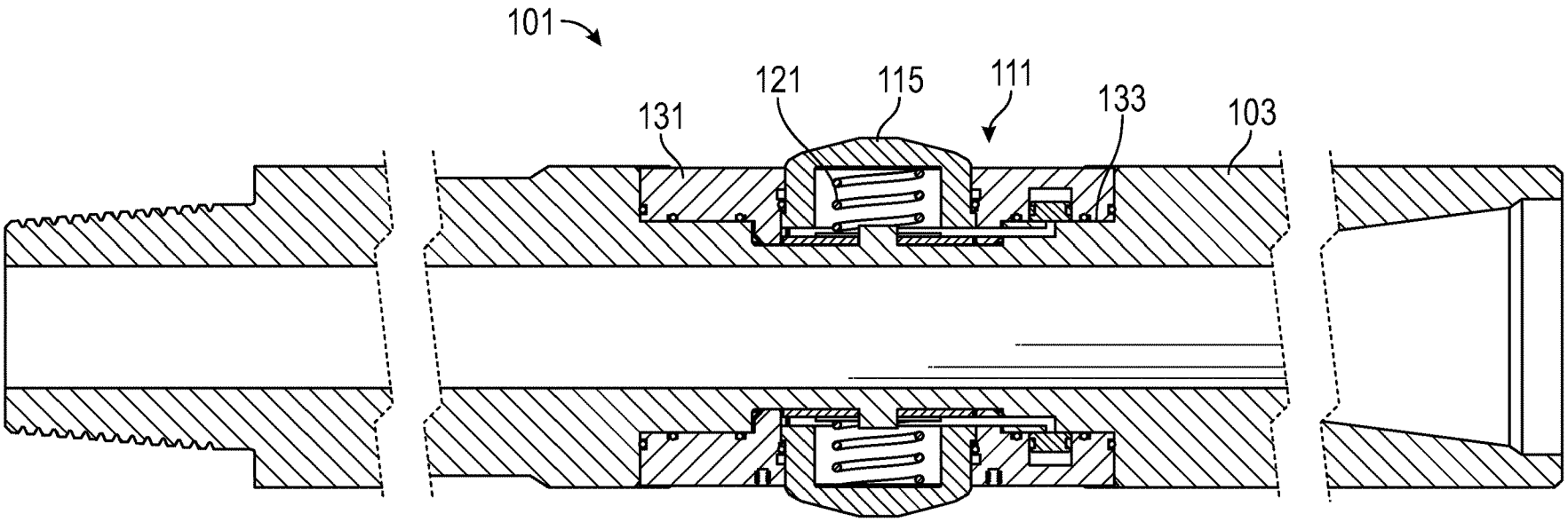
FIG. 7 is a longitudinal sectional view of another embodiment of a downhole tool.

In still other embodiments (FIG. 7), the radial shock absorber 111 can be configured as an integrated, stand-alone (self-contained), sealed cartridge that is coupled to the device 101 or body 103. For example, the piston 115 and spring 121 can be contained within a sealed housing 131 that is then attached (e.g., bolted) to the body 103, such as in a recess 133 in the body 103. Functionally, this embodiment can be identical or similar to the other embodiments.

In addition, any feature described for a particular embodiment may be included with any other embodiment disclosed herein. Other embodiments can include one or more of the following items.

1. A device for use downhole in a drill string, the device comprising:
   a body that is cylindrical and comprises a longitudinal axis and top and bottom threads configured to couple the body to other elements of the drill string;
   a radial shock absorber coupled to an exterior of the body, and the radial shock absorber comprises:
      a piston having a piston axis, a portion of the piston extends to an exterior of the body, and the piston is configured to move along the piston axis between a retracted position and an extended position; and
      a spring located between the body and the piston such that the spring is configured to bias the piston, along the piston axis, radially outward relative to the longitudinal axis of the body.
2. The device wherein the radial shock absorber further comprises a vibration dampener to dampen movement of the piston.
3. The device wherein the vibration dampener comprises a hydraulic dampener.
4. The device wherein the radial shock absorber further comprises an additional piston that is hydraulically coupled to the piston to compensate for movement of the piston.
5. The device wherein the radial shock absorber is configured to hold the device stationary in a well bore.
6. The device further comprising an electronic control to actuate the radial shock absorber.
7. The device wherein the piston and spring are coaxial, and the radial shock absorber further comprises a central axial stem on which the spring is mounted.
8. The device wherein the radial shock absorber further comprises a sacrificial bearing coupled around the central axial stem between the body and the piston.
9. The device wherein the radial shock absorber is mounted in a recess in the body.
10. The device wherein the radial shock absorber further comprises a cover plate that is coupled to the body to contain the piston.
11. The device wherein the radial shock absorber comprises an integrated, stand-alone, sealed cartridge that is coupled to the body.
12. The device wherein the piston can be selectively locked in the extended position and controlled to act as a rigid body without spring action, and selectively unlocked to allow motion of the piston along the piston axis.
13. A device for use downhole in a drill string, the device comprising:
   a body that is cylindrical and comprises a longitudinal axis and top and bottom threads configured to couple the body to other elements of the drill string;
   radial shock absorbers coupled to an exterior of the body, and each radial shock absorber comprises:
      a piston having a piston axis, a portion of the piston extends to an exterior of the body, and the piston is configured to move along the piston axis between a retracted position and an extended position;
      a spring located between the body and the piston such that the spring is configured to bias the piston, along the piston axis, radially outward relative to the longitudinal axis of the body; and
      a vibration dampener to dampen movement of the piston.
14. The device wherein each vibration dampener comprises a hydraulic dampener, and each radial shock absorber further comprises an additional piston that is hydraulically coupled to the piston to compensate for movement of the piston.
15. The device wherein the radial shock absorbers are configured to hold the device stationary in a well bore, and further comprising an electronic control to actuate the radial shock absorbers.
16. The device wherein respective ones of the piston and spring are coaxial, and each radial shock absorber further comprises a central axial stem on which the spring is mounted.
17. The device wherein each radial shock absorber further comprises a sacrificial bearing located between the body and the piston.
18. The device wherein each radial shock absorber is mounted in a recess in the body.
19. The device wherein each radial shock absorber comprises an integrated, stand-alone, sealed cartridge that is coupled to the body.
20. The device wherein each piston can be selectively locked in the extended position and controlled to act as a rigid body without spring action, and selectively unlocked to allow motion of the piston along the piston axis.

None of the descriptions in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle.

What is claimed is:

1. A device for use downhole in a drill string, the device comprising:
   a body that is cylindrical and comprises a longitudinal axis and top and bottom threads configured to couple the body to other elements of the drill string;
   a radial shock absorber coupled to an exterior of the body, and the radial shock absorber comprises:
   a piston having a piston axis, a portion of the piston extends to an exterior of the body, and the piston is configured to move along the piston axis between a retracted position and an extended position and, in the extended position, the piston is configured to directly contact a well bore; and
   a bias member located between the body and the piston such that the bias member is configured to bias the piston, along the piston axis, radially outward relative to the longitudinal axis of the body;
   wherein the radial shock absorber further comprises a vibration dampener to dampen movement of the piston;
   wherein the vibration dampener comprises a hydraulic dampener; and
   wherein the radial shock absorber further comprises an additional piston that is hydraulically coupled to the piston to compensate for movement of the piston.

2. The device of claim 1, wherein the radial shock absorber is configured to hold the device stationary in a well bore.

3. The device of claim 1, further comprising an electronic control to actuate the radial shock absorber.

4. The device of claim 1, wherein the piston and bias member are coaxial, and the radial shock absorber further comprises a central axial stem on which the bias member is mounted.

5. The device of claim 4, wherein the radial shock absorber further comprises a sacrificial bearing coupled around the central axial stem between the body and the piston.

6. The device of claim 1, wherein the radial shock absorber is mounted in a recess in the body.

7. The device of claim 1, wherein the radial shock absorber further comprises a cover plate that is coupled to the body to contain the piston.

8. The device of claim 1, wherein the radial shock absorber comprises an integrated, stand-alone, sealed cartridge that is coupled to the body.

9. The device of claim 1, wherein the piston can be selectively locked in the extended position and controlled to act as a rigid body without spring action, and selectively unlocked to allow motion of the piston along the piston axis.

10. A device for use downhole in a drill string, the device comprising:

a body that is cylindrical and comprises a longitudinal axis and top and bottom threads configured to couple the body to other elements of the drill string;

radial shock absorbers coupled to an exterior of the body, and each radial shock absorber comprises:

a piston having a piston axis, a portion of the piston extends to an exterior of the body, and the piston is configured to move along the piston axis between a retracted position and an extended position;

a bias member located between the body and the piston such that the bias member is configured to bias the piston, along the piston axis, radially outward relative to the longitudinal axis of the body; and a vibration dampener to dampen movement of the piston, and each vibration dampener comprises a hydraulic dampener, and each radial shock absorber further comprises an additional piston that is hydraulically coupled to the piston to compensate for movement of the piston.

11. The device of claim 10, wherein the radial shock absorbers are configured to hold the device stationary in a well bore, and further comprising an electronic control to actuate the radial shock absorbers.

12. The device of claim 10, wherein respective ones of the piston and bias member are coaxial, and each radial shock absorber further comprises a central axial stem on which the bias member is mounted.

13. The device of claim 10, wherein each radial shock absorber further comprises a sacrificial bearing located between the body and the piston.

14. The device of claim 10, wherein each radial shock absorber is mounted in a recess in the body.

15. The device of claim 10, wherein each radial shock absorber comprises an integrated, stand-alone, sealed cartridge that is coupled to the body.

16. The device of claim 10, wherein each piston can be selectively locked in the extended position and controlled to act as a rigid body without spring action, and selectively unlocked to allow motion of the piston along the piston axis.

* * * * *